US006409296B1

(12) United States Patent
Misumi et al.

(10) Patent No.: US 6,409,296 B1
(45) Date of Patent: Jun. 25, 2002

(54) LIQUID DISCHARGE METHOD, LIQUID DISCHARGE HEAD AND LIQUID DISCHARGE APPARATUS

(75) Inventors: Yoshinori Misumi; Hiroyuki Ishinaga, both of Tokyo; Yoichi Taneya, Yokohama; Hiroyuki Sugiyama, Sagamihara; Satoshi Shimazu, Yokohama, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/624,380

(22) Filed: Jul. 27, 2000

(30) Foreign Application Priority Data

Jul. 27, 1999 (JP) ..... 11-212904

(51) Int. Cl.[7] ..... B41J 29/38; B41J 2/05
(52) U.S. Cl. ..... 347/11; 347/65
(58) Field of Search ..... 347/11, 15, 9, 347/63, 65, 67

(56) References Cited

U.S. PATENT DOCUMENTS

| | | | | |
|---|---|---|---|---|
| 4,503,444 A | * | 3/1985 | Tacklind | 347/15 |
| 4,723,129 A | | 2/1988 | Endo et al. | 347/56 |
| 5,278,585 A | * | 1/1994 | Karz et al. | 347/65 |
| 5,600,349 A | * | 2/1997 | Keefe | 347/11 |
| 6,070,970 A | | 6/2000 | Ogasawara et al. | 347/65 |
| 6,095,640 A | | 8/2000 | Ishinaga et al. | 347/65 |

FOREIGN PATENT DOCUMENTS

| | | | | |
|---|---|---|---|---|
| EP | 0 124 190 A | | 11/1984 | H04N/1/032 |
| EP | 436047 A1 | | 7/1991 | B41J/2/055 |
| EP | 0 609 997 A | | 8/1994 | B41J/2/05 |
| EP | 0721841 A | * | 7/1996 | B41J/2/05 |
| EP | 0811493 A | | 12/1996 | B41J/2/05 |
| EP | 0 811 492 A | | 12/1997 | B41J/2/05 |
| EP | 0 921 002 A | | 6/1999 | B41J/2/14 |
| JP | 6-31918 | | 2/1994 | B41J/2/05 |
| JP | 9-48127 | | 2/1997 | B41J/2/05 |
| JP | 9-323420 | | 12/1997 | B41J/2/05 |
| JP | 10-24588 | | 1/1998 | B41J/2/05 |

* cited by examiner

*Primary Examiner*—John Barlow
*Assistant Examiner*—Juanita Stephens
(74) *Attorney, Agent, or Firm*—Fitzpatrick, Cella, Harper & Scinto

(57) ABSTRACT

The invention is to vary the amount of the liquid discharged from a same discharge port, thereby realizing recording of multi gradation levels. After the discharge of a first liquid droplet 66*a*, a second liquid droplet 66*b* is discharged while the movable member 31 is still in a displaced state. In comparison with the first liquid droplet 66*a*, the second liquid droplet 66*b* has a larger discharge energy and a larger speed, because the moving energy of the movable member 31 and the energy consumed for the liquid flow opposite to the discharge port 18 are small. Thus the first and second droplets are united to form a united droplet 66*d* before landing on the recording medium 150. In this manner the amount of the discharged liquid can be varied.

27 Claims, 13 Drawing Sheets

10
50
64
M
65
13
31
32
2
18
34
33
1

66a
40

67
66a 67
66a
66b 67
66a
66b

150

10
64
M
67
66a
66b
18
2
31
34
1

67
66c 67
66c 67
66a
66b
66c 66d
66c 66e
150

LIQUID DISCHARGE METHOD, LIQUID DISCHARGE HEAD AND LIQUID DISCHARGE APPARATUS

BACKGROUND OF THE INVENTION

1. Field of the Invention

The present invention relates to a liquid discharge method for discharging desired liquid by bubble generation induced by applying thermal energy to liquid, a liquid discharge head and a liquid discharging apparatus utilizing such liquid discharge method, and particularly to a liquid discharge method employing a movable member displaced utilizing the bubble generation, and a liquid discharge head and a liquid discharge apparatus utilizing such liquid discharge method.

The present invention is applicable also to an apparatus for example a printer for recording on a recording medium such as paper, yarn, fiber, cloth, leather, metal, plastics, glass, wood or ceramics, a copying apparatus, a facsimile apparatus having a communication system, or a word processor having a printer unit, or to an industrial recording apparatus combined in complex manner with various processing apparatus.

In the present invention, recording means not only providing the recording medium with a meaningful image such as a character or graphics but also with a meaningless image such as a pattern.

2. Related Background Art

There is already known so-called bubble jet recording method, or an ink recording method in which for example thermal energy is given to liquid ink contained to generate a state change involving a rapid volume change (generation of a bubble) therein, and the ink is discharged from a discharge port by an action force based on such state change and is deposited on a recording medium to form an image. The recording apparatus utilizing such bubble jet recording method is generally provided, as disclosed in the U.S. Pat. No. 4,723,129, with a discharge port for discharging ink, an ink flow path communicating with the discharge port, and an electrothermal converting member constituting energy generation means for discharging ink contained in the flow path.

Such recording method, being capable of recording a high quality image at a high speed with a low noise level and also of arranging the discharge ports for ink discharge at a high density in the recording head for executing such recording method, has various advantages such as ability to recording an image of a high definition with a compact apparatus and to record a color image easily. Such bubble jet recording method is recently employed in various office equipment such as a printer, a copying apparatus, a facsimile apparatus etc. and even to industrial systems such as a print dyeing apparatus.

With such spreading of application of the bubble jet technology, there are being generated various requirements as explained in the following.

For obtaining an image of high quality, there are proposed a driving condition for realizing a liquid discharge method capable of providing a high ink discharge speed and achieving satisfactory ink discharge based on stable bubble generation, and an improved shape of the flow path for obtaining a liquid discharge head with a high liquid refilling speed into the flow path, in view of the high speed recording.

In addition to such head structures, the Japanese Patent Application Laid-Open No. 6-31918 takes into consideration a backward wave (pressure generated in a direction opposite to that toward the discharge port) and discloses a structure capable of preventing the backward wave causing an energy loss at the ink discharge (specifically in FIG. 3 of the same patent application). In the liquid discharge head disclosed in the above-mentioned patent application, a triangular portion of a triangular plate-shaped member is positioned opposed to the heater for generating the bubble. In such liquid discharge head, the backward wave is temporarily and slightly suppressed by the plate-shaped member, but the relationship between the bubble growth and the triangular portion of the plate-shaped member is not at all disclosed nor considered, so that the above-mentioned liquid discharge head has the following drawbacks.

In the above-mentioned patent application, the shape of the liquid droplet cannot be stabilized since the heater is positioned in the bottom of a recess and is not in linear communication with the discharge port and the bubble growth from a side of the triangular plate-shaped member to the entire other side since the bubble growth is permitted from the vicinity of the apex of the triangular portion, whereby the bubble executes ordinary growth in the liquid as if the plate-shaped member is not present. Consequently the presence of the plate-shaped member does not affect at all the grown bubble. Inversely, since the plate-shaped member is entirely surrounded by the bubble, the liquid refill to the heater position at the bottom of the recess generates a random flow at the contraction of the bubble, thereby resulting in accumulation of small bubbles in the recess and disturbing the liquid discharging principle itself based on the bubble growth.

On the other hand, the EP laid-open No. 436047A1 discloses an invention of alternately opening a first valve for intercepting a path between an area in the vicinity of the discharge port and a bubble generating portion and a second valve for intercepting a path between the bubble generating portion and an ink supply portion (cf. FIGS. 4 to 9 in the EP laid-open No. 436047A1). In such invention, however, since only two of the three chambers are separated at a time, the ink discharged following the ink droplet forms a large trailing, whereby a satellite dots considerably increase in comparison with the ordinary liquid discharge method executing the bubble growth, bubble contraction and bubble vanishing. This is presumably because the effect of meniscus retraction by the vanishing of bubble cannot be utilized. Also at the liquid refilling, the liquid is supplied to the bubble generating portion by the bubble vanishing, but cannot be supplied to the area in the vicinity of the discharge port until a next bubble is generated, so that such liquid discharger head not only shows a large fluctuation in the discharged liquid droplet but also has a very low response frequency of liquid discharge, thus being not in the practical level.

Also there have been made various proposals on a liquid discharge head different completely from the aforementioned liquid discharge head and having a movable member capable of effectively contributing to the liquid discharge droplet (for example a plate-shaped member of which a free end is positioned closer than the fulcrum thereof to the discharge port). Among such proposals, the Japanese Patent Application Laid-Open No. 9-48127 discloses a liquid discharge head capable of limiting the upper limit of displacement of the aforementioned movable member, in order to prevent a slight aberration in the behavior of such movable member. Also the Japanese Patent Application Laid-Open No. 9-323420 discloses a liquid discharge head in which the position of a common liquid chamber, formed at the upstream side of the aforementioned movable member, is shifted to the free end side thereof, namely to the downstream side, utilizing the advantage of the movable member, thereby improving the refilling ability. Since these inventions have been based on a concept that the growing bubble, temporarily retained by the movable member, is suddenly released toward the discharge port, the various factors of the entire bubble relating to the liquid droplet formation and the mutual relationships of such factors have not been considered.

As a next step, the Japanese Patent Application Laid-Open No. 10-24588 discloses an invention of releasing a part of the bubble generating area from the aforementioned movable member, in consideration of the bubble growth by propagation of the pressure wave (acoustic wave) as a factor relating to the liquid discharge. However, also this invention considers only the bubble growth at the liquid discharge, so that the various factors of the entire bubble relating to the liquid droplet formation and the mutual relationships of such factors have not been considered.

Also it is already known, in the liquid discharge head of edge shooter type (a head having the discharge port in a direction parallel to the heater forming plane), that a frontal portion (portion close to the discharge port) of the bubble generated by film boiling significantly influences the liquid discharge, but there has not been considered to utilize such portion for more effectively forming the liquid droplet to be discharged, and the present invention has been reached as a result of intensive investigation for technically clarifying these factors.

In addition, in the most of prior art, plural heat generating member are selectively driven to modulate a discharge amount or perform multi-value gradation recording. Such structure has a difficulty in disposing each of plural heat generating members to an optimum position and in making a head compact.

The present invention is one of those reached in the course of detailed analysis of the process from the generation of the bubble to the extinction thereof, and has attained a technical level much higher than the prior technology, in realizing multi-value gradation recording and attaining stable image quality in the continuous discharge operation.

SUMMARY OF THE INVENTION

The principal objects of the present invention are as follows.

A first object of the present invention is to provide an extremely novel liquid discharge principle by controlling the generated bubble and the liquid at the discharge port side and at the supply side of the bubble by a movable member and a structure of the entire liquid flow path.

A second object of the present invention is to unite plural discharged liquid droplets in continuous discharging operation and to cause such united droplet on a recording medium, thereby enabling to control the discharge amount of the liquid droplet discharged from a same nozzle and realizing recording of multi gradation levels.

A third object of the present invention is to provide a liquid discharge apparatus capable of attaining high speed recording and high image quality at the same time.

The above-mentioned objects can be attained, according to the present invention, by a liquid discharge method consisting of heating liquid in a liquid flow path to generate and grow a bubble in the liquid, displacing a movable member formed as a beam supported at an end thereof and provided in the liquid flow path from an initial state according to the growth of the bubble, thereby suppressing the flow of the liquid toward the upstream side of the liquid flow path and the growth of the bubble, discharging the liquid as a droplet from a discharge port communicating with the downstream side of the liquid flow path by the pressure resulting from the growth of the bubble, and, after the discharge of the liquid droplet, returning the movable member from the displaced state to the initial state according to the extinction of the bubble, wherein, in case of executing continuous liquid discharge from the same liquid flow path, the heating of the liquid for the next liquid discharge is initiated before the vibration of the movable member returning from the displaced state after the preceding liquid discharge completely converges and while the movable member displaced to the initial position, thereby discharging plural liquid droplets in continuous manner from the same discharge port and whereby the plural liquid droplets are united into a single liquid droplet before landing on the recording medium.

The aforementioned liquid discharge method is featured in that the movable member at the start of second or subsequent bubble generation is in a displaced state, and the displacement amount of the movable member (amount of movement of the movable member from the initial state to the displaced state) at the start of bubble generation is larger than the displacement amount of the movable member at the start of preceding bubble generation.

The aforementioned liquid discharge method is featured in that, in the continuous discharge of liquid droplets, the discharge speed of a succeeding liquid droplet is larger than that of a preceding liquid droplet.

In the aforementioned liquid discharge method, it is preferred that a heat generating member is provided in the liquid flow path and is driven to execute heading of the liquid. In such case, the heat generating member may be an electrothermal converting member which may be given a driving pulse to execute heating of the liquid.

According to the present invention, there is also provided a liquid discharge apparatus which is equipped with the aforementioned liquid discharge head and recording medium conveying means for conveying a recording medium for receiving the liquid discharged from the liquid discharge head, which executes recording by causing the liquid discharge head to discharge ink and depositing the ink onto the recording medium.

In the description of the present specification, the expression upstream or downstream is used with respect to the direction of flow of the liquid from a liquid supply source through a bubble generating area (or movable member) toward a discharge port or to the direction of such configuration.

Also the downstream side of the bubble itself means a bubble generated in an area at the downstream side in the aforementioned flow direction or configurational direction with respect to the center of the bubble or in an area of the heat generating member at the downstream side with respect to the aerial center thereof. Similarly, the upstream side of the bubble itself means a bubble generated in an area at the upstream side in the aforementioned flow direction or configurational direction with respect to the center of the bubble or in an area of the heat generating member at the upstream side with respect to the aerial center thereof.

Also in the present invention, substantial contact between the movable member and a limiting portion therefor may be a directly contacting state or a closely positioned state where liquid of a thickness of several micrometers is present between the two.

DESCRIPTION OF THE PREFERRED EMBODIMENTS

In the following the present invention will be clarified in detail by preferred embodiments thereof, with reference to the accompanying drawings.

Figures 1A, 1B, 1C, 1D, 1E, 1F:
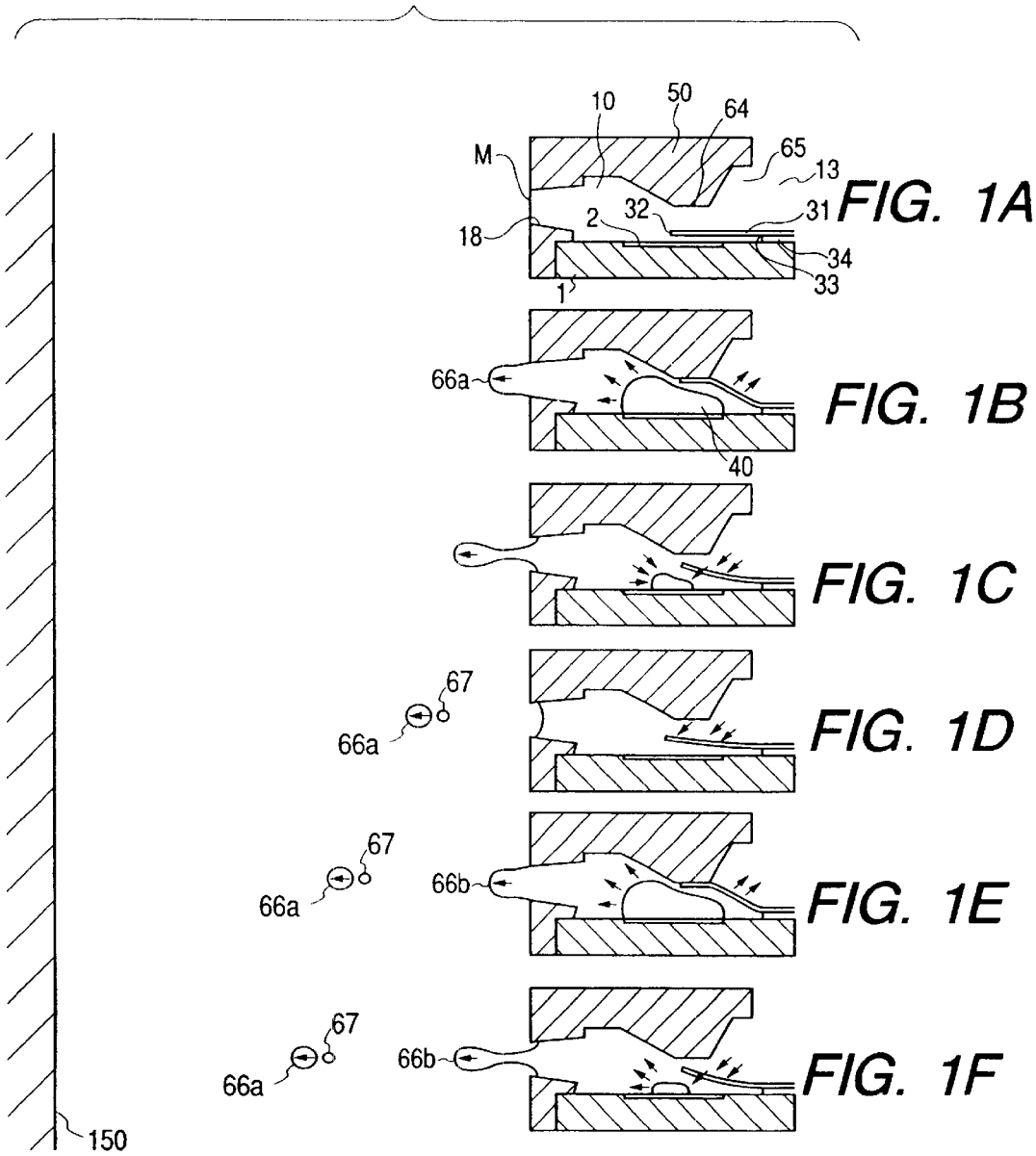
FIGS. 1A, 1B, 1C, 1D, 1E and 1F is a cross-sectional view along the liquid flow path of an embodiment of the liquid discharge head of the present invention, showing steps (a) to (f) of three consecutive liquid discharge operations.
Figures 2G, 2H, 2I, 2J, 2K, 2L:
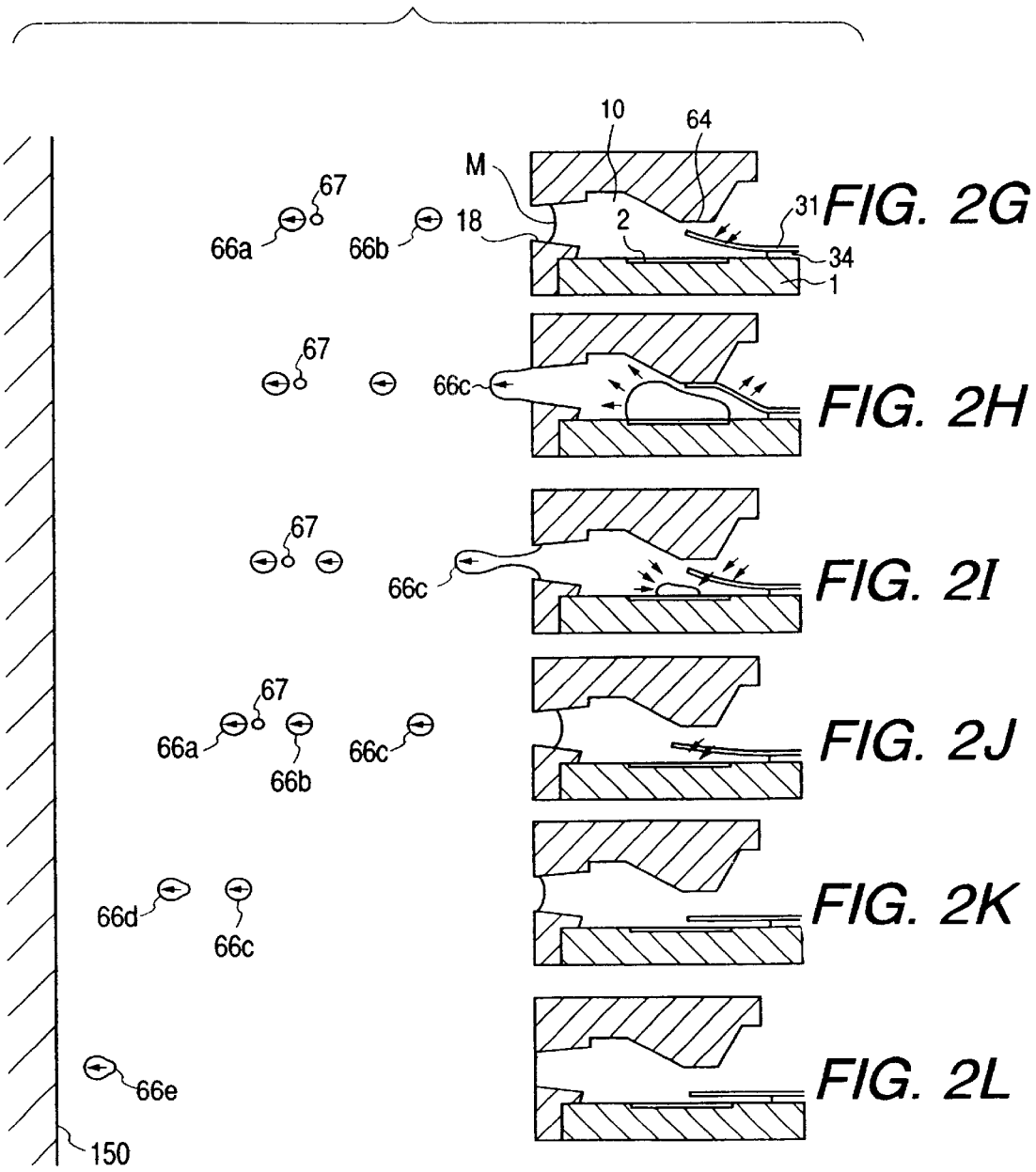
FIGS. 2G, 2H, 2I, 2J, 2K, and 2L is a cross-sectional view showing steps (g) to (l) succeeding to those in FIG. 1.

FIGS. 1 and 2 are cross-sectional views, along the liquid flow path, of a liquid discharge head constituting an embodiment of the present invention, showing feature phenomena in the liquid flow path in steps (a) to (f) in FIG. 1 and (g) to (l) in FIG. 2.

In the liquid discharge head of the present embodiment, a flat element substrate 1 is provided thereon with a heat generating member 2 as a discharge energy generating element for generating energy for discharging liquid and for giving thermal energy to the liquid, and a liquid flow path 10 is formed corresponding to the heat generating member 2 on the element substrate 1. The liquid flow path 10 communicates with a discharge port 18 and with a common liquid chamber 13 for supplying plural liquid flow paths 10 with the liquid, and receives, from the common liquid chamber 13, the liquid of an amount corresponding to that discharged from the discharge port 18. The meniscus M of the liquid filling the liquid flow path 10 is in an equilibrium state in the vicinity of the discharge port 18, by the capillary force generated by the inner wall of the discharge port 18 and the liquid flow path 10 communicating therewith and the generally negative internal pressure of the common liquid chamber 13.

The liquid flow path 10 is constituted by adjoining of the element substrate 1 bearing the heat generating member 2 and a top plate 50, and, in the vicinity of a contact plane between the heat generating member 2 and the discharge liquid, there exists a bubble generating area for generating a bubble in the discharge liquid when the heat generating member 2 is rapidly heated. In the liquid flow path 10 having such bubble generating area, a movable member 31 is provided in such a manner that at least a part is opposed to the heat generating member 2. The movable member 31 is formed as a beam supported at an end, and has a free end 32 at the downstream side closer to the discharge port 18 and is supported by a support member 34 positioned at the upstream side of the liquid flow path 10. Particularly in the present embodiment, the free end 32 is positioned in the vicinity of the center of the bubble generating area (heat generating member 2), in order to suppress the growth of the upstream half of the bubble, influencing the backward wave to the upstream side and the inertial force of the liquid. The movable member 31 is rendered displaceable with respect to the support member 34, according to the growth of the bubble generated in the bubble generating area. A fulcrum 33 of such displacement constitutes an end of the supporting portion for the movable member 31 in the support member 34.

Above the center of the bubble generating area, a stopper (limiting portion) 64 is provided for limiting the displacement of the movable member 31 within a predetermined range, in order to suppress the growth of the upstream half of the bubble. In the liquid flow from the common liquid chamber 13 to the discharge port 18, there is provided a low flow path resistance area 65, at the upstream side of the stopper 64, having a flow path resistance lower than that in the liquid flow path 10. In the low flow path resistance area 64, the resistance of the flow path to the liquid movement is reduced by a structure without the upper wall and with a larger cross section.

The above-described configuration provides a characteristic head structure capable of suppressing the liquid flow toward the upstream side of the liquid flow path and the growth of the bubble toward the upstream side by the displaceable movable member.

Figure 3:
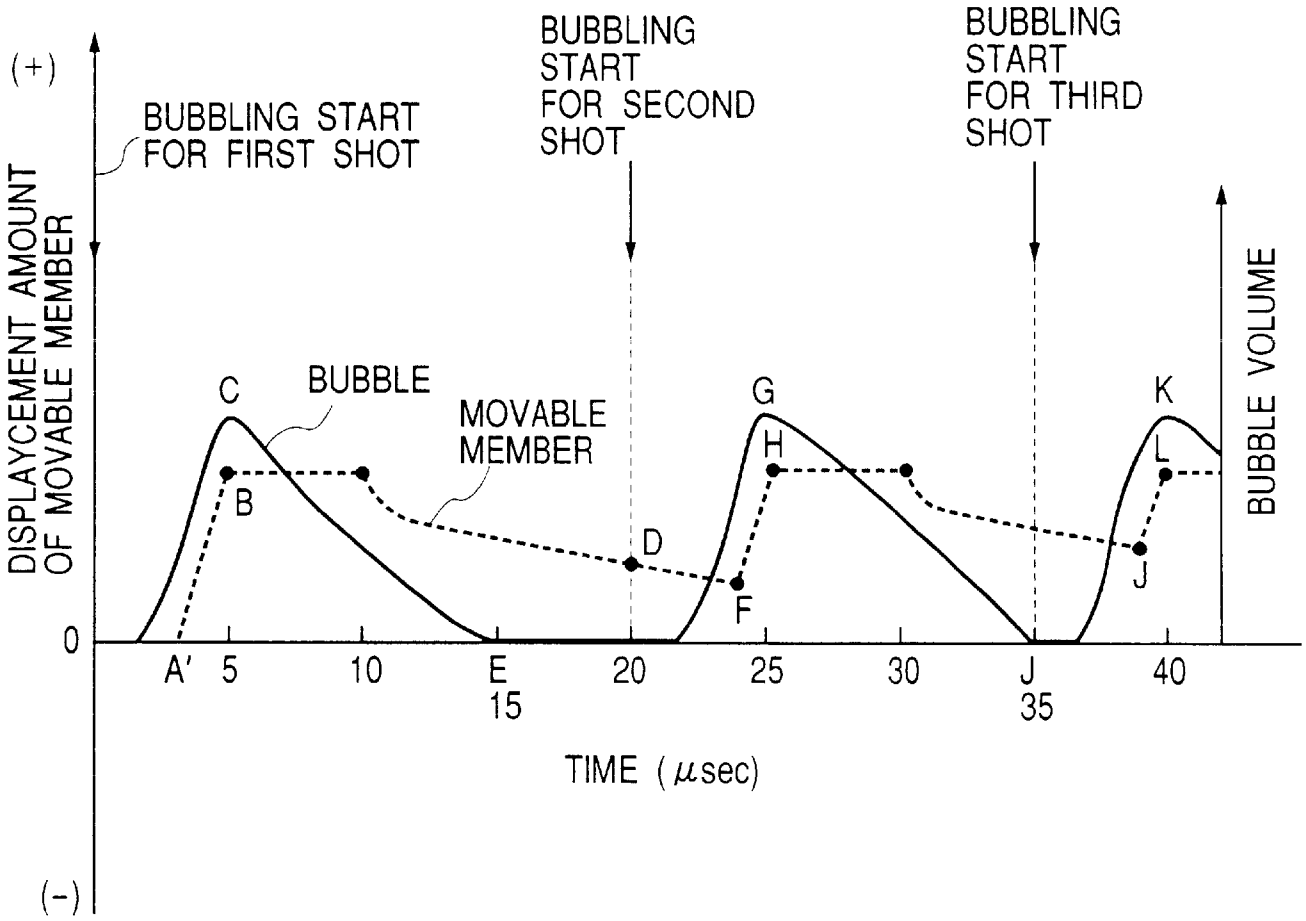
FIG. 3 is a chart showing the relationship between the growth of a bubble and the displacement of a movable member.

In the following there will be explained in detail the discharging operation of the liquid discharge head of the present embodiment. FIGS. 1 and 2 show the states of liquid discharge from first to third droplets in three consecutive discharge operations and of landing of the discharged liquid droplet on the recording medium. Also FIG. 3 shows the change in the volume of the bubble 40 and in the displacement amount of the movable member 31.

In FIG. 1, (a) indicates a state prior to the application of energy, such as electrical energy, to the heat generating member 2, thus prior to the heat generation thereby. It is to be noted that the movable member 31 is in a position (initial position) opposed to the upstream half of the bubble generated by the heat from the heat generating member 2, and that the stopper 64 for limiting the displacement of the movable member 31 is provided above the center of the bubble generating area (heat generating member 2). Stated differently, the liquid flow path and the movable member 31 are so constructed as to suppress the upstream half of the bubble. Also as shown in FIG. 3, when an electrical pulse is applied to the heat generating member 2 at a time T=0, a part of the liquid present in the bubble generating area is heated by the heat generating member 2 to generate a bubble by film boiling phenomenon, and the bubble 40 grows with the lapse of time. By the repulsive force of the movable member 31, the displacement thereof starts (point A in FIG. 3) later than the volume change of the bubble 40.

The growth of the bubble 40 causes a liquid movement to the upstream side, namely toward the common liquid chamber 13, and such movement becomes a large current because of the presence of the low flow path resistance area 65, but, when the movable member 31 is displaced to a position in contact with or close to the stopper 64, the further displacement of the movable member 31 is restricted (point B in FIG. 3) whereby the liquid movement to the upstream side is mainly suppressed at such point. Thus, in such displaced state of the movable member 31, the resistance to the liquid flow toward the upstream side (at least upstream of the center of the bubble generating area) of the liquid flow path 10 increases whereby the movement of the liquid and the bubble between the liquid flow path 10 and the common liquid chamber 13 at the upstream side thereof is significantly suppressed. Accordingly, the growth of the bubble toward the upstream side is also suppressed by the movable member 31. However, since the liquid has a large moving force toward the upstream side, the movable member 31 is subjected to a strong stress toward the upstream side and is retained in a bent state, while the bubble 40 continues to grow to a maximum volume (point C in FIG. 3).

In FIG. 1, (b) indicates a state where the bubble in the bubble generating area has grown to maximum. In this state, the pressure based on the bubble generation causes the liquid in the liquid flow path 10 to move toward the downstream side and the upstream side, whereby, in the upstream side, the movable member 31 is displaced by the growth of the bubble 40, while, in the downstream side, a first liquid droplet 66*a* is just to leave the discharge port 18.

Figure 4:
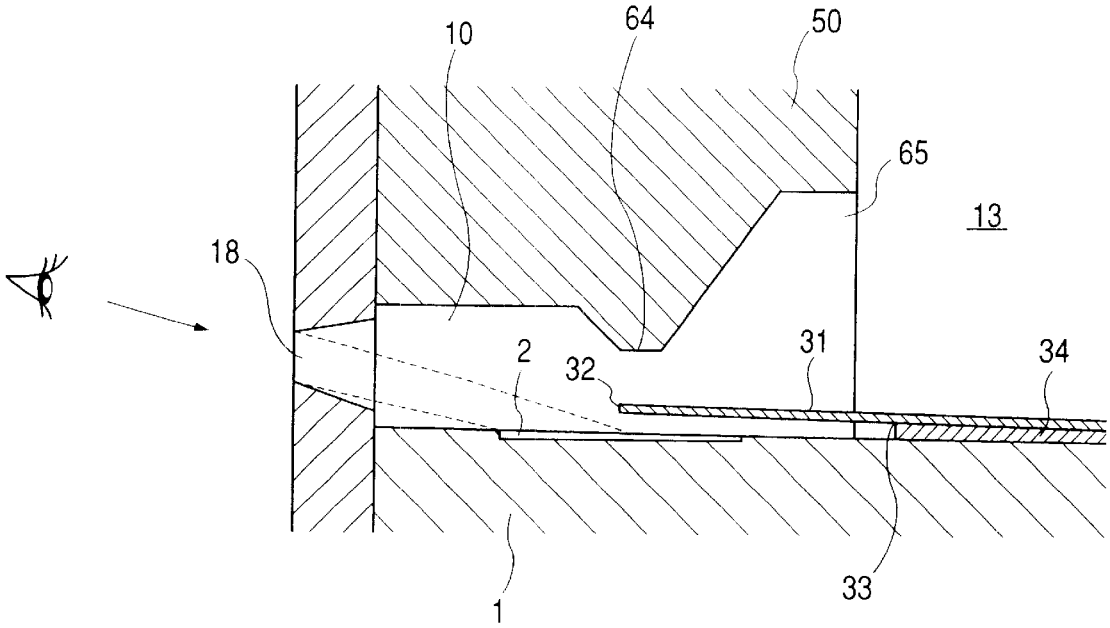
FIG. 4 is a cross-sectional view of the liquid flow path in the liquid discharge head of the present invention, showing a linear communicating state thereof.

In the present invention, as shown in FIG. 4, between a portion of the bubble 40 at the side of the discharge port 18 and the discharge port there is realized a "linear communication state" maintaining a straight flow path structure with respect to the liquid flow. Such structure is desirable in realizing an ideal state in which the propagating direction of the pressure wave generated at the bubble generation, the liquid flowing direction resulting therefrom and the liquid discharging direction preferably coincide linearly, thereby stabilizing the discharge states such as the discharge direction of the liquid droplet 66 and the discharge direction thereof at an extremely high level.

In the present invention, as a factor for realizing such ideal state or a state close thereto, there is adopted a configuration in which the discharge port 18 and the heat generating member 2, particularly a portion thereof close to the discharge port (downstream side), influencing a portion of the bubble 40 at the side of the discharge port 18, can be directly connected by a straight line. In such configuration, the heat generating member 2, particularly the downstream side thereof, is observable through the discharge port 18 when seen from the outside thereof in the absence of the liquid in the liquid flow path 10.

Thereafter, as shown in (c) in FIG. 1, the negative pressure in the bubble 40 after the aforementioned film boiling overcomes the moving force of the liquid toward the downstream side in the liquid flow path 10, whereby the bubble 40 starts to contract. At this point, since the moving force of the liquid toward the upstream side by the growth of the bubble 40 still strongly remains by the pressure difference between the upstream side and the downstream side across the movable member 31, the movable member 31 is still in a state in contact with the stopper 64 for a certain period after the start of contraction of the bubble 40, so that the contraction of the bubble 40 mostly induces the movement of the liquid from the discharge port 18 to the upstream side. Stated differently, immediately after the state (b) in FIG. 1, the contact of the displaced movable member 31 and the stopper 64 increases the flow resistance of the liquid flow path 10 in the upstream side thereof, whereby the contracting energy of the bubble 40 serves to move the liquid in the vicinity of the discharge port 18 toward the upstream side. Consequently the meniscus M is retracted at this point from the discharge port 18 into the liquid flow path 10, thereby promptly cutting off a liquid column connected to the first discharged liquid droplet 66*a* with a strong force. As a result, as shown in (d) in FIG. 1, the first liquid droplet 66*a* is discharged from the discharge port 18, and there is reduced another droplet 67 constituting a satellite (sub droplet), left outside the discharge port 18. When the movable member starts to displace downward immediately thereafter, the liquid at the upstream side is rapidly refilled as shown in (d) in FIG. 1, whereby the retraction of the meniscus M into the liquid flow path 10 can be maintained at a minimum amount. In the present embodiment, the first discharged liquid droplet 66*a* from the discharge port had a speed of 10 m/s and an amount of 6 pl.

In FIG. 1, (d) indicates a state after the completion of a bubble extinction step and immediately before the start of application of a second electrical pulse to the heat generating member 2. This state corresponds, in the chart shown in FIG. 3, to a time t=20, $\mu$s, where the movable member 31 is in a still displaced state D.

In FIG. 1, (e) indicates a state where the second bubble in the bubble generating area has grown to maximum. In this state, the pressure based on the bubble generation causes the liquid in the liquid flow path 10 to move toward the downstream side and the upstream side, whereby, in the upstream side, the movable member 31 is displaced by the growth of the bubble 40, while, in the downstream side, a second liquid droplet 66*b* is just to leave the discharge port 18. As the movable member 31 is in a displaced state at the start of generation of the second bubble, the liquid flow in the liquid flow path 10 toward the upstream side thereof during the bubble growth is more suppressed than that in the first bubble, whereby the discharge energy toward the downstream direction (discharging direction) is increased. According to the experimental result of the present inventors, the second liquid droplet 66*b* had a speed 12.5 m/s and a discharge amount of 5 pl.

In FIG. 1, (f) indicates the repetition of a bubble extinction step similar to that shown in (c) in FIG. 1.

In FIG. 2, (g) indicates a state after the completion of a second bubble extinction step and immediately before the start of application of a third electrical pulse to the heat generating member 2. At this point, when the movable member starts to displace downward in the same manner as in (d) in FIG. 1, the liquid at the upstream side is rapidly refilled whereby the retraction of the meniscus M into the liquid flow path 10 can be maintained at a minimum amount.

This state corresponds, in the chart shown in FIG. 3, to a time t=35 ps, where the movable member 31 is n a still displaced state I. As will be apparent from the comparison of points D and I in FIG. 3, the displacement amount of the movable member 31 at this point is larger than that immediately before the start of generation of the second bubble.

In FIG. 2, (h) indicates a state where the third bubble in the bubble generating area has grown to maximum. In this state, the pressure based on the bubble generation causes the liquid in the liquid flow path 10 to move toward the downstream side and the upstream side, whereby, in the upstream side, the movable member 31 is displaced by the growth of the bubble 40, while, in the downstream side, a third liquid droplet 66*c* is just to leave the discharge port 18. As the displacement amount of the movable member 31 at the start of generation of the third bubble is larger than that at the start of generation of the second bubble, the liquid flow in the liquid flow path 10 toward the upstream side thereof during the bubble growth is more suppressed than that in the second bubble, whereby liquid flow in the liquid flow path 10 toward the upstream side during the bubble growth is more suppressed than in the second bubble, and the discharge energy toward the downstream direction (discharging direction) is increased. According to the experimental result of the present inventors, the third liquid droplet 66*c* had a speed 14.5 m/s and a discharge amount of 5 pl.

In FIG. 2, (i) indicates the repetition of a bubble extinction step similar to that shown in (c) and (f) in FIG. 1.

In FIG. 2, (j) indicates the repetition of a refilling step similar to that shown in (d) in FIG. 1 and (g) in FIG. 2, and such refilling allows to minimize the retraction of the meniscus M into the liquid flow path 10.

In FIG. 2, (k) indicates a state, after the consecutive discharges of three liquid droplets 66 and before the first liquid droplet 66*a* reaches the recording medium 150, the second liquid droplet 66*b* flying at a speed of 12.5 m/s reaches and is united with the first droplet flying at 10 m/s, constituting a united liquid droplet 66*d* consisting of the first and second droplets, having an amount of 11 pl.

In FIG. 2, (l) indicates a state, the third liquid droplet 66*c* flying at a speed of 14.5 m/s reaches and is united with the united droplet 66*d* formed in the state (k), constituting a united liquid droplet 66*e* consisting of the first, second and third droplets, having an amount of 16 pl.

In the three consecutive discharging operations described above, there are generated:

first droplet 66*a* of a speed 10.0 m/s and an amount 6 pc;

second droplet 66*b* of a speed 12.5 m/s and an amount 5 pc; and third droplet 66*c* of a speed 14.5 m/s and an amount 5 pc;

wherein the second droplet 66*b* is delayed by 20 $\mu$s from the first droplet 66*a* and the third droplet 66*c* is delayed by 35 $\mu$s from the first droplet 66*a*. Consequently, if the distance from the front end of the discharge port 18 of the head to the recording medium 150 is 1.5 mm, the second droplet 66*b* and the third droplet 66*c* can be united with the first droplet 66*a* prior to the landing thereof onto the recording medium 150.

The amount of the second liquid droplet 66*b* is smaller than that of the first liquid droplet 66*a* because, at the start of the second droplet discharge, the meniscus M is somewhat retracted into the liquid flow path 10 (cf. (c) in FIG. 1), whereby the liquid amount on which the heat generating member 2 acts becomes smaller in the second discharge than in the first discharge. Because the amount of the second droplet 66*b* is smaller than that of the first droplet 66*a* in addition to a fact that the discharge energy applied to the second droplet 66*b* is larger than that applied to the first droplet 66*a* as explained in the foregoing, the second droplet has a larger discharge speed than that of the first droplet whereby the second droplet 66*b* can catch up the first droplet 66*a*.

Therefore, there can be realized representation of four gradation levels of 6, 11 and 16 pl, respectively corresponding to the discharge of a droplet, consecutive discharges of two droplets and consecutive discharges of three droplets.

In the following there will be explained the effects featuring the present embodiment.

Figure 5:
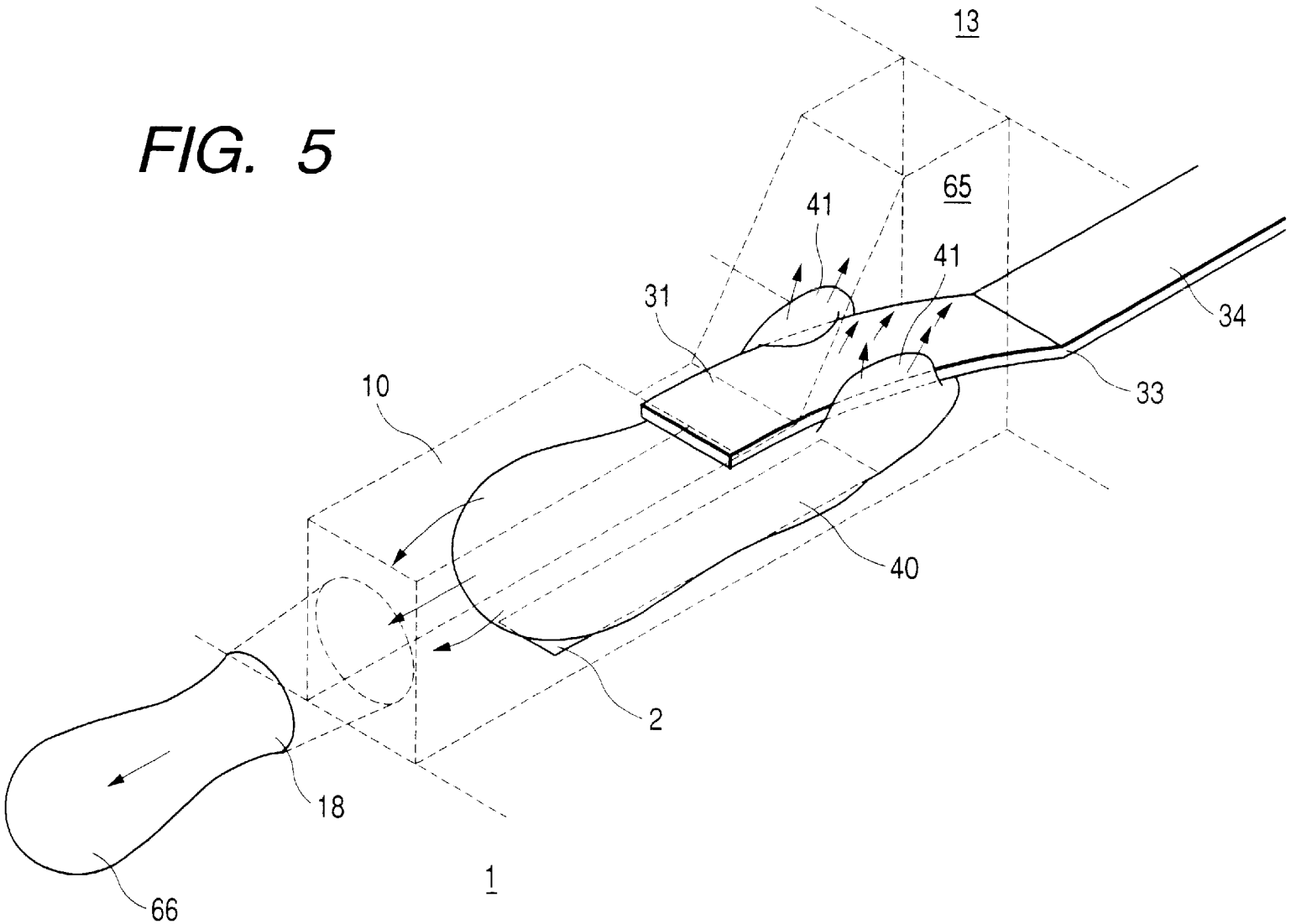
FIG. 5 is a perspective view of the liquid discharge head shown in FIG. 1.

FIG. 5 is a perspective view of a part of the head basically same as that shown in FIGS. 1 and 2 except that the nozzle is removed and represented by broken lines. In the present embodiment, there are provided small clearances between the side walls constituting the liquid flow path 10 and the both sides of the movable member 31 to enable smooth displacement thereof. Also in the course of growth of the bubble generated by the heat generating member 2, the bubble 40 displaces the movable member 31 and extends through the above-mentioned clearances to the upper side of the movable member 31, thus somewhat intruding in the low flow path resistance area 65, such extended and intruding bubble 41 extends further to the back side (opposite to the bubble generating area) of the movable member 31, thereby suppressing the vibration thereof and stabilizing the discharge characteristics.

Also in the extinction step of the bubble 40, the extended bubble 41 stimulates the liquid flow from the low flow path resistance area 65 to the bubble generating area, thereby promptly completing the extinction of the bubble, in combination with the rapid retraction of the meniscus from the discharge port 18. In particular, the liquid flow induced by the extended bubble 41 almost completely prevents staying of a bubble in the corner of the movable member 31 or of the liquid flow path 10.

In the present embodiment there has been explained a case of representing 4 gradation levels by discharging and uniting 3 liquid droplets, but it is also possible to represent 3 gradation levels by discharging and uniting 2 liquid droplets or a larger number of gradation levels by discharging and uniting a larger number of liquid droplets. As described above, recording is performed by uniting droplets discharged successively from a single discharge port, so that it is easy to control a discharge amount, a discharge direction is stabilized regardless of droplet amount, and influence of satellite can be suppressed.

Figure 15A:
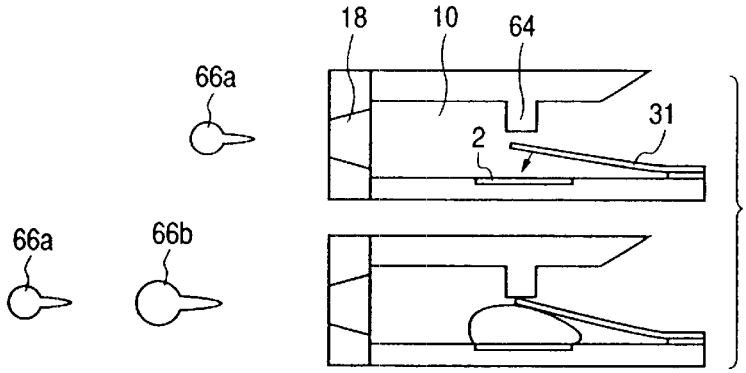
FIGS. 15A, 15B, and 15C illustrates a modified example of the embodiment.
Figure 15B:
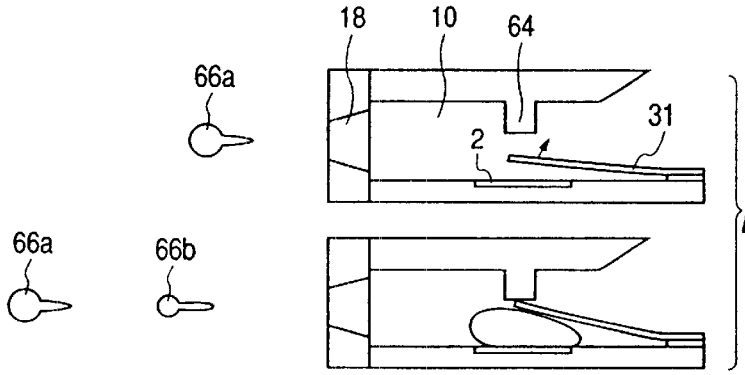
Figure 15C:
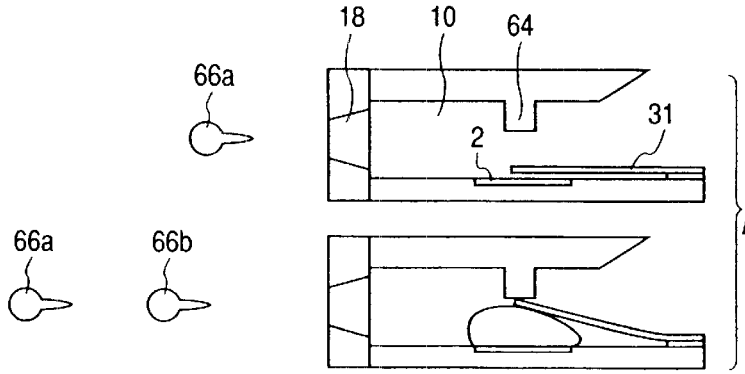

Further, discharged liquid droplets are all substantially the same in size in the above-mentioned embodiment. However, the invention is not limited to the embodiment. In a case where an amount of first droplet is differentiated from that of successive droplet to execute gradation recording as illustrated in FIG. 15, it is preferable to change the size of the successive droplet with a size of a first droplet being substantially the same. (a) of FIG. 15 illustrates an arrangement that a discharge amount of a droplet successive to a first droplet is greater. than that of the first droplet by discharging the droplet successive to the first droplet by driving a heat generating member during downward (which is a direction approaching to the heat generating member) displacement of a movable member; (b) of FIG. 15 illustrates an arrangement that a discharge amount of a droplet successive to a first droplet is fewer than that of the first droplet by discharging the droplet successive to the first droplet by driving a heat generating member during upward (which is a direction separating away from the heat generating member) displacement of a movable member; and further, (c) of FIG. 15 illustrates an arrangement that a discharge amount of a droplet successive to a first droplet is substantially the same as that of the first droplet by discharging the droplet successive to the first droplet by driving a heat generating member when a movable member returns to a stationary position. As described above, a discharge amount of the successive droplet can be controlled by changing a driving timing for discharging a droplet successive to a first droplet. That modulation of a discharge amount can stabilize a bubbling state upon discharging each droplet, thereby making error in discharge amount of droplet few.

Further, the upper portion of (a) of FIG. 15 shows a state immediately before a second bubble generation, where the movable member 31 is falling. The lower portion of (a) of FIG. 15 shows that two droplets are consecutively discharged and a discharge amount of the first droplet 66*a* is greater than that of the second one 66*b*.

The upper portion of (b) of FIG. 15 shows a state immediately before a second bubble generation, where the movable member 31 is rising. The lower portion of (b) of FIG. 15 shows that two droplets are consecutively discharged and a discharge amount of the first droplet 66*a* is smaller than that of the second one 66*b*.

The upper portion of (c) of FIG. 15 shows a state immediately before a second bubble generation, where the movable member 31 is in an initial state. The lower portion of (c) of FIG. 15 shows that two droplets are consecutively discharged and a discharge amount of the first droplet 66*a* is substantially equal to that of the second one 66*b*.

Furthermore, the invention is not limited to the gradation recording in which a different discharge amount is discharged from a same discharge port. For example, the invention is applicable to an arrangement for differentiating a discharge amount in accordance with a kind of ink. In the arrangement, a discharge amount can be changed by a same heat generating member or movable member so that it is not necessary to change a layout of a heating member substrate for the modulation and a difference of discharge amount can be set without any limitation.

In the following there will be explained other embodiments applicable to a head utilizing the above-described liquid discharge method.

Other Embodiments

<Side Shooter Type>

In the following there will be explained other embodiments of the present invention, with reference to the accompanying drawings.

Figure 12A:
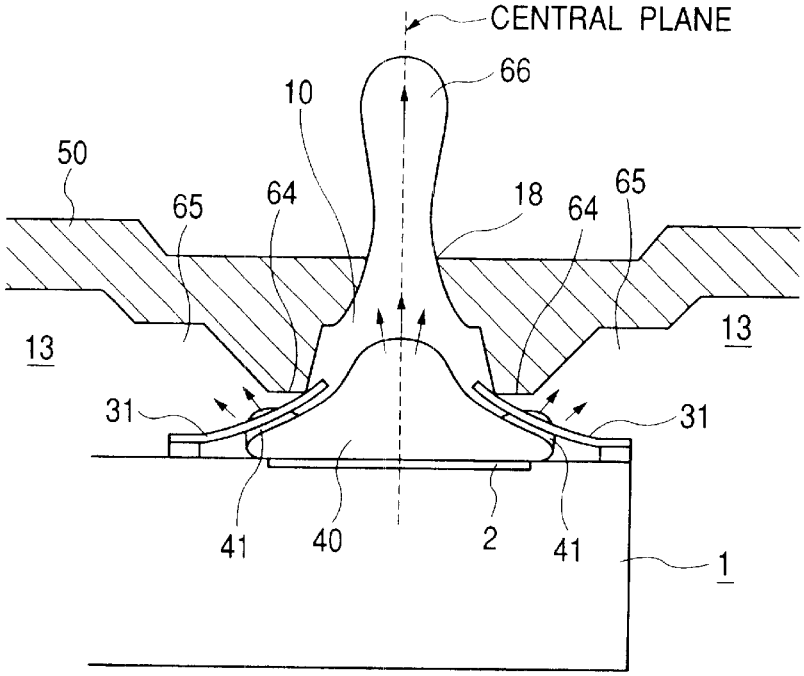
FIGS. 12A and 12B are views showing a liquid discharge head of side shooter type employing the liquid discharge head of the present invention.
Figure 12B:
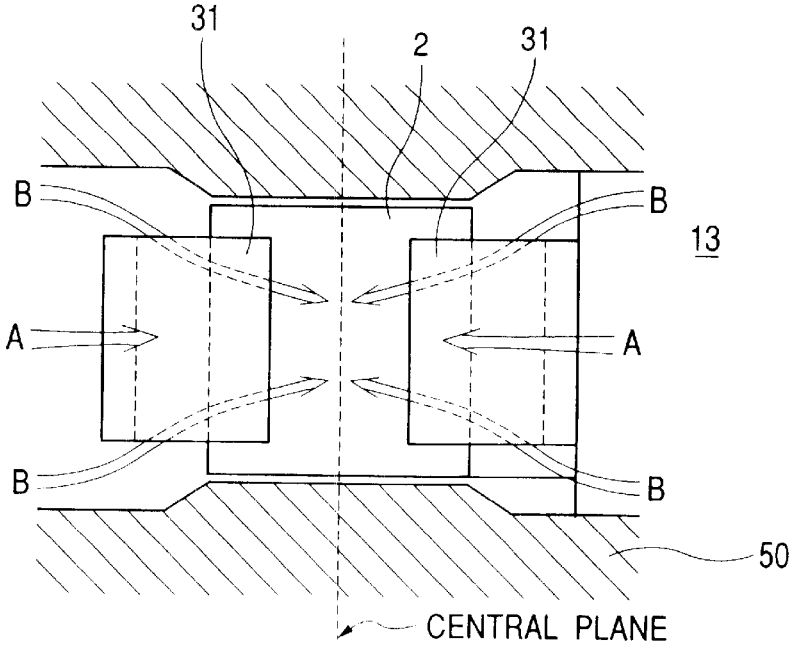

In the following there will be explained the application of the liquid discharge principle, explained with reference to FIGS. 1, 2 and 3, to a head of side shooter type in which the heat generating member 2 and the discharge port 18 are mutually opposed on parallel planes. FIGS. 12A and 12B are views showing a liquid discharge head of such side shooter type, wherein a heat generating member 2 on an element substrate 1 and a discharge port 18 formed on a top plate 50 are so provided as to be mutually opposed. The discharge port 18 communicates with a liquid flow path 10 passing on the heat generating member 2. In the vicinity of a contact plane between the heat generating member 2 and the liquid, there is provided a bubble generating area. On the element substrate 1 there are supported two movable members 31, which are so formed as to be symmetrical with respect to a plane passing the center of the heat generating member 2 and as that the free ends of the movable members 31 are mutually opposed on the heat generating member 2. The movable members 31 have a same projection area on the heat generating member 2, and the free ends of the movable members 31 are separated by a desired distance. Each movable member 31 is so positioned, when the head is divided by an imaginary dividing wall passing through the center of the heat generating member 2, that the free end of the movable member 31 is positioned close to the center of thus divided portion of the heat generating member 2.

The top plate 50 is provided with stoppers 64 for limiting the displacement of the movable members 31 within a certain range. In the liquid flow from a common liquid chamber 13 to the discharge port 18, there is provided a low flow path resistance area 65, at the upstream side of the stopper 64, having a flow path resistance lower than that in the liquid flow path 10. In the low flow path resistance area 64, the resistance of the flow path to the liquid movement is reduced by a larger cross section than in the liquid flow path 10.

In the following there will be explained the effects featuring the configuration of the present embodiment.

FIG. 12A indicates a state where a part of the liquid in the bubble generating area is heated by the heat generating member 2 and a bubble 40 generated by a film boiling phenomenon has grown to maximum. In this state, the pressure based on the bubble generation causes the liquid in the liquid flow path 10 to move toward the discharge port 18, whereby the movable members 31 are displaced by the growth of the bubble 40, while a first liquid droplet 66*a* is just to leave the discharge port 18. The liquid movement toward the common liquid chamber 13 becomes a large current because of the presence of the low flow path resistance area 65, but, when the movable members 31 are displaced to a position in contact with or close to the stoppers 64, the further displacement of the movable members 31 is restricted whereby the liquid movement to the upstream side is also suppressed at such point. At the same time, the growth of the bubble toward the upstream side is also suppressed by the movable members 31. However, since the liquid has a large moving force toward the upstream side, a part of the bubble 40, of which growth is restricted by the movable members 31, extends through the gaps between the side walls constituting the liquid flow path 10 and the side portions of the movable members 31 extends to the upper side of the movable members 31, thus forming extended bubbles 41.

When the bubble 40 starts to contact after the aforementioned film boiling, the moving force of the liquid toward the upstream side by the growth of the bubble 40 still strongly remains by the pressure difference between the upstream side and the downstream side across the movable members 31, so that the movable members 31 are still in a state in contact with the stoppers 64, whereby the contraction of the bubble 40 mostly induces the movement of the liquid from the discharge port 18 to the upstream side.

When the bubble extinction step is almost completed, the repulsive force (returning force) of the movable members 31 becomes stronger than the upward moving force of the liquid in the low flow path resistance areas 65, whereby initiated are a downward displacement of the movable members 31 and a liquid flow toward the downstream side in the low flow path resistance areas 65. At the same time, the flows toward the downstream side in the low flow path resistance area 65 rapidly become large currents and enter the liquid flow path 10 through the portions of the stoppers 64. FIG. 12B shows the liquid flows A, B in the extinction step of the bubble 40. The liquid flow A is a component flowing from the common liquid chamber 18 toward the discharge port 18 through the upper side (opposite to the heat generating member 2) of the movable members 31, while the liquid flow B is a component flowing through both sides of the movable members 31 and above the heat generating member 2.

In the present embodiment, as explained in the foregoing, the refilling of the liquid can be made at a higher speed by liquid supply through the low flow path resistance areas 65. Also the refilling is achieved at an even higher speed because the flow path resistance is made even lower in the common liquid chamber 13 adjacent to the low flow path resistance areas 65.

Also in the extinction step of the bubble 40, the extended bubbles 41 stimulate the liquid flow from the low flow path resistance areas 65 to the bubble generating area, thereby promptly completing the extinction of the bubble, in combination with the rapid retraction of the meniscus from the discharge port 18. In particular, the liquid flows induced by the extended bubbles 41 almost completely prevent staying of a bubble in the corner of the movable members 31 or of the liquid flow path 10.

Also in the liquid discharge head shown in FIGS. 12A and 12B, in case of consecutive liquid discharge from the same discharge port 18, a driving pulse is applied to the heat generating member 2 to initiate the generation of the bubble 40 after the preceding liquid discharge and before the vibration of the movable members 31 returning from the displaced state to the initial state is attenuated, namely while the movable members 31 displace toward the stoppers 64, as in the foregoing embodiment shown in FIGS. 1 to 4.

It is thus rendered possible to discharge the succeeding liquid droplet in the discharge direction, more efficiently than the preceding liquid droplet, thereby enabling the next liquid droplet to unite with the preceding liquid droplet before the landing thereof onto the recording medium.

<Movable Member>

Figure 6A:
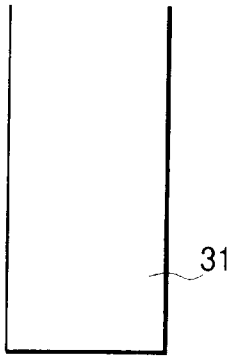
FIGS. 6A, 6B and 6C are views showing examples of the movable member of the liquid discharge head shown in FIGS. 1 and 2.
Figure 6B:
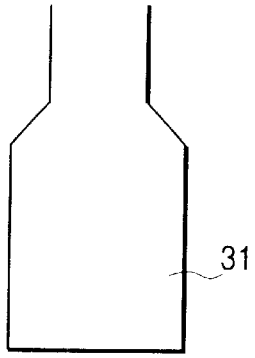
Figure 6C:
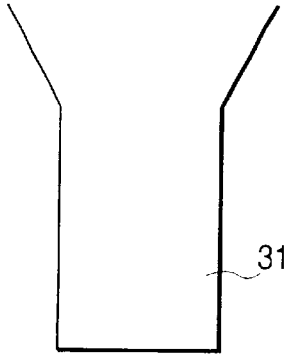

FIGS. 6A to 6C show other shapes of the movable member 31, wherein FIG. 6A shows a rectangular shape; FIG. 6B shows a shape with a narrower fulcrum side to facilitate the displacement of the movable member; and FIG. 6C shows a shape with a wider fulcrum side to increase the rigidity of the movable member.

In the foregoing embodiments, the movable member 31 is composed of SiN of a thickness of 5 $\mu$m, but such configuration is not restrictive and the movable member may be composed of any material having resistance to the discharge liquid and elasticity for satisfactorily functioning as the movable member 31.

The movable member is desirably composed of a material of high durability, for example a metal such as silver, nickel, gold, iron, titanium, aluminum, platinum, tantalum, stainless steel or phosphor bronze; alloys thereof; resin having nitrile radicals such as acrylonitrile, butadiene or styrene; resin having amide radicals such as polyamide; resin having carboxyl radicals such as polycarbonate; resin having aldehyde radicals such as polyacetal; resin having sulfone radicals such as polyslfone; other resins such as liquid crystal polymer and compounds thereof; or of high ink resistance, for example a metal such as gold, tungsten, tantalum, nickel, stainless steel or titanium or alloys thereof or substances surfacially coated with such metal or alloy; resin having amide radicals such as polyamide; resin having aldehyde radicals such as polyacetal; resin having ketone radicals such as polyetherether ketone; resin having imide radicals such as polyimide; resin having hydroxyl radicals such as phenolic resin; resin having ethyl radicals such as polyethylene; resin having alkyl radicals such as polypropylene; resin having epoxy radicals such as epoxy resin; resin having amino radicals such as melamine resin; resin having methylol radicals such as xylene resin; and compounds thereof; or ceramics such as silicon dioxide or silicon nitride or compounds thereof. The movable member in the present invention has a thickness in the order of micrometers.

In the following there will be explained the positional relationship between the heat generating member and the movable member. The optimum arrangement of the heat generating member 2 and the movable member 31 allows to appropriately control and effectively utilize the liquid flow at the bubble generation by the heat generating member 2.

Figure 8:
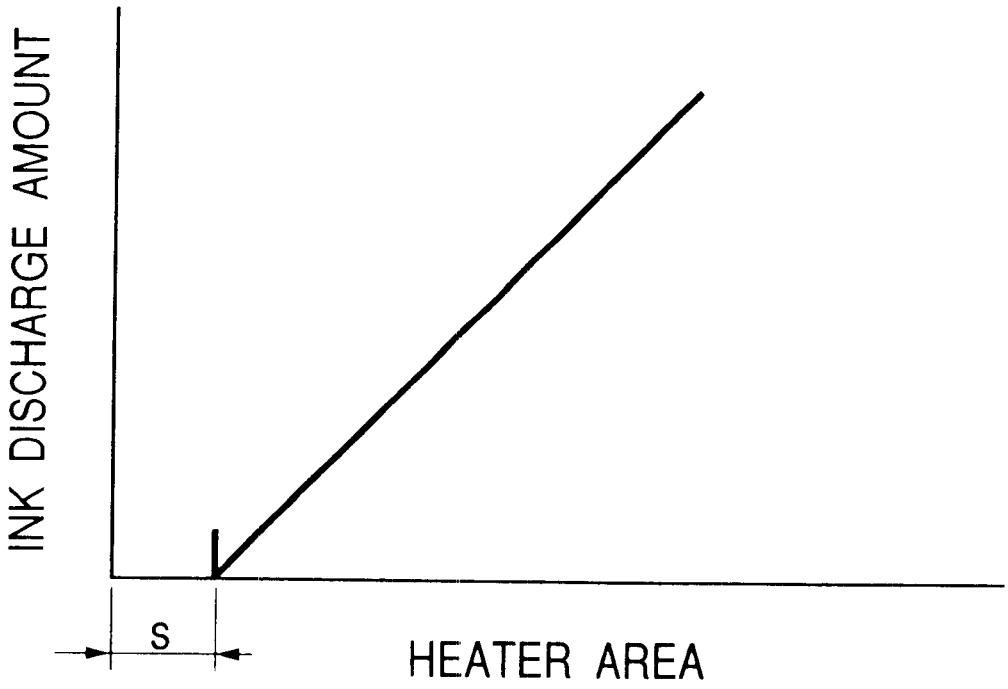
FIG. 8 is a chart showing the relationship between the area of the heat generating member and the ink discharge amount.

In the conventional technology of so-called bubble jet recording method, namely an ink jet recording method in which energy such as heat is given to the ink to generate a state change involving a rapid volume change (bubble generation) in the ink, and the ink is discharged from the discharge port by the action force based on such state change and is deposited on the recording medium to form an image, the area of the heat generating member is proportional to the ink discharge amount as shown in FIG. 8, but there is present a non-effective bubble generating area S not contributing to the ink discharge. Based on the state of kogation on the heat generating member 2, such non-effective bubble generating area S is known to be present around the heat generating member. Based on these results, an area of a width of about 4 $\mu$m around the heat generating member is regarded not to contribute to the bubble generation.

Therefore, for effectively utilizing the pressure of the generated bubble, the movable member can be acted on directly above an area of the heat generating member inside such peripheral area of the width of about 4 $\mu$m. In the present invention, however, in consideration of the fact that there can be separated a stage of causing the upstream portion and the downstream portion of the bubble in the approximately central area (in practice a range of about ±10 $\mu$m with respect to the center along the liquid flow) of the bubble generating area to independently act on the liquid flow in the liquid flow path and a stage of causing the bubble to comprehensively act on the liquid flow, it is extremely important to position the movable member in such a manner that a portion upstream of the above-mentioned central area alone is opposed to the movable area of the movable member. In the foregoing embodiments, the effective bubble generating area is considered as an area of the heat generating area inside a peripheral area of a width of about 4 $\mu$m, but such area is not limited to such definition, depending on the kind of the heat generating member of the forming method thereof.

Figure 7:
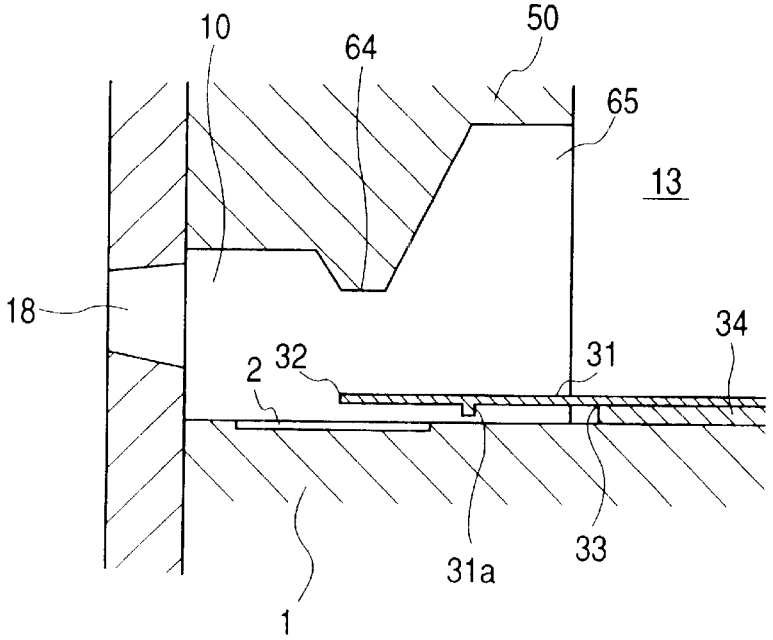
FIG. 7 is a view showing another configuration of the movable member.

Also as shown in FIG. 7, the movable member 31 may be provided with a projection 31*a* (hereinafter called "downward projection") positioned close to the bubble generating area and protruding toward the element substrate 1. The downward projection 31*a* is to suppress the growth of the bubble, generated in the bubble generating area, in the backward direction (toward the upstream side), and allows to reduce the backward growth of the bubble in comparison with the case without such lower side projections 31*a*. Suppressing the backward growth of the bubble 40, the downward projection 31*a* causes the discharge energy to effectively contribute to the ink discharge.

The downward projection 31*a* is desirably provided in a position at least separate from the stepped portion around the heat generating member 2, since it may come into contact with the element substrate 1 when the movable member 31 is displaced toward the element substrate 1. More specifically, the downward projections 31*a* is separated at least by 5 μm from the effective bubble generating area. However, it cannot exert the effect of suppressing the backward growth of the bubble if it is excessively distant from the bubble generating area, so that it is desirably provided within a range from the effective bubble generating area of the heat generating member 2 to an approximate half of the length of the heat generating member. More specifically, in the present embodiment, the distance from the effective bubble generating area to the downward projections 31*a* is abut 45 μm, preferably not exceeding 30 μm and more preferably not exceeding 20 μm.

Also the height of the downward projection 31*a* is approximately equal to or less than the distance between the movable member 31 and the element substrate 1, whereby, in the present embodiment, there is formed a slight clearance between the end of the downward projections 31*a* and the element substrate 1.

Such downward projection 31*a* suppresses the extension of the bubble 40, generated in the bubble generating area, toward the upstream side through the gap between the movable member 31 and the element substrate 1, whereby the liquid movement to the upstream side is further reduced and the refilling characteristics can be further improved.

Also in case of bubble generation in the liquid with such movable member 31, at the initial stage of the bubble generation where the growth of the bubble 40 is rapid, the downward projection 31*a* substantially closes the bubble generating area at the upstream side. Therefore the pressure wave generated by the bubble generation does not proceeds to the upstream side, whereby the pressure wave can be effectively directed to the downstream side and made to contribute to the ink discharge.

Also in the liquid discharge head utilizing such movable member 31, it is possible to consecutively discharge the liquid droplets from the same discharge port 18 and to unite the plural discharged liquid droplets thereby realizing recording of multi gradation levels.

<Element Substrate>

Figure 9A:
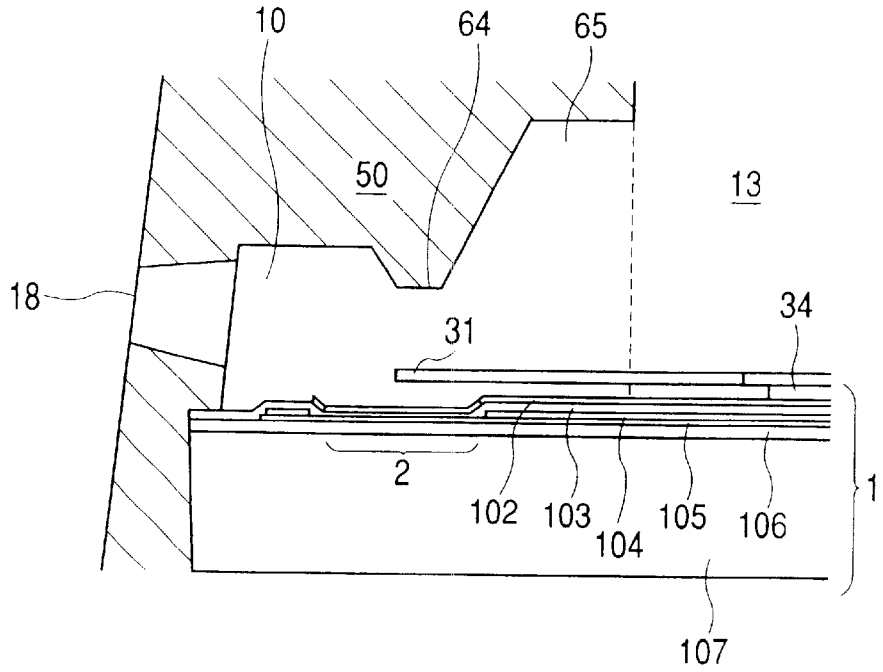
FIGS. 9A and 9B are longitudinal cross-sectional views of a liquid discharge head of the present invention, respectively with or without a protective film on the heat generating member.
Figure 9B:
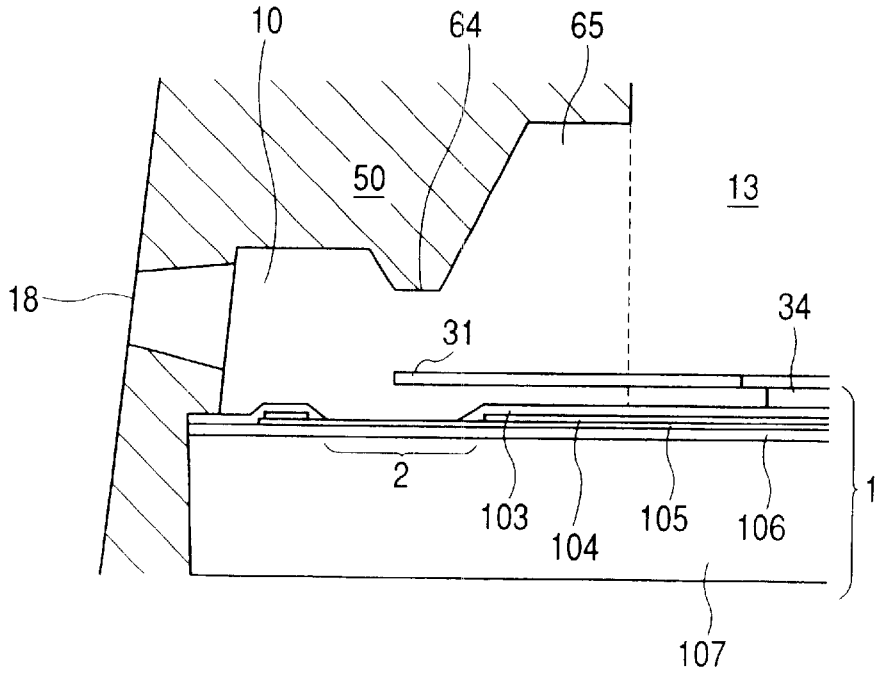

In the following there will be explained the configuration of the element substrate 1. FIGS. 9A and 9B are schematic cross-sectional views of the liquid discharge head of the present invention, respectively with and without a protective film to be explained later. On the element substrate 1, there is provided a top plate 50 provided with grooves for constituting the liquid flow paths 10, the discharge ports 18 communicating with the liquid flow paths 10, the low flow path resistance area 65 and the common liquid chamber 13.

The element substrate 1 is obtained by forming, on a substrate 107 such as of silicon, a silicon oxide or silicon nitride film 106 for insulation and head accumulation, and patterning thereon an electrical resistance layer 105 (0.01 to 0.2 μm thick) of hafnium boride ($HfB_2$), tantalum nitride (TaN) or tantalum aluminum (TaAl) constituting the heat generating members 2 and wiring electrodes 104 (0.2 to 1.0 μm thick) for example of aluminum, as shown in FIG. 9A. A voltage is applied to the resistance layer 105 from the wiring electrodes 106 thereby generating a current in the resistance layer to generate heat therefrom. On the resistance layer between the wiring electrodes 104, there are formed a protective layer 103 of silicon oxide or silicon nitride with a thickness of 0.1 to 2.0 μm and thereon an anticavitation layer 102 (0.1 to 0.6 μm thick) for example of tantalum, in order to protect the resistance layer 105 from various liquids such as ink.

As the pressure or impact wave generated at the generation or extinction of the bubble 40 is very strong and significantly deteriorate the durability of the hard and brittle oxide film, there is employed the anticavitation layer 102 of a metallic material such as tantalum.

Also the resistance layer 105 may be so constructed as to dispense with the protective layer 103, by the suitable combination of the liquid, the configuration of the liquid flow path 10 and the material constituting the resistance layer, as illustrated in FIG. 9B. Such resistance layer 105 not requiring the protective layer 103 may be composed, for example, of iridium-tantalum-aluminum alloy.

Thus, the aforementioned heat generating member 2 may be constructed by positioning the electrical resistance layer (heat generating portion) 105 between the wiring electrodes 104, or may include the protective layer 102 for protecting the electrical resistance layer 105.

In the foregoing description, the heat generating member 2 is composed of the electrical resistance layer 105 generating heat in response to an electrical signal, but such configuration is not restrictive and there may be employed any configuration capable of generating, in the liquid, the bubble sufficient for discharging the liquid. For example, the heat generating portion may be composed of an optothermal converting member capable of heat generation in response to light such as laser light, or a member capable of heat generation in response to a high frequency wave.

The aforementioned element substrate 1 may be provided, in addition to electrothermal converting elements consisting of the electrical resistance layer 105 constituting the heat generating portions and the wiring electrodes 104 for supplying the resistance layer 105 with the electrical signal, with functional elements such as transistors, diodes, latches, shift registers etc. for selectively driving the electrothermal converting elements, integrally by a semiconductor manufacturing process.

Figure 10:
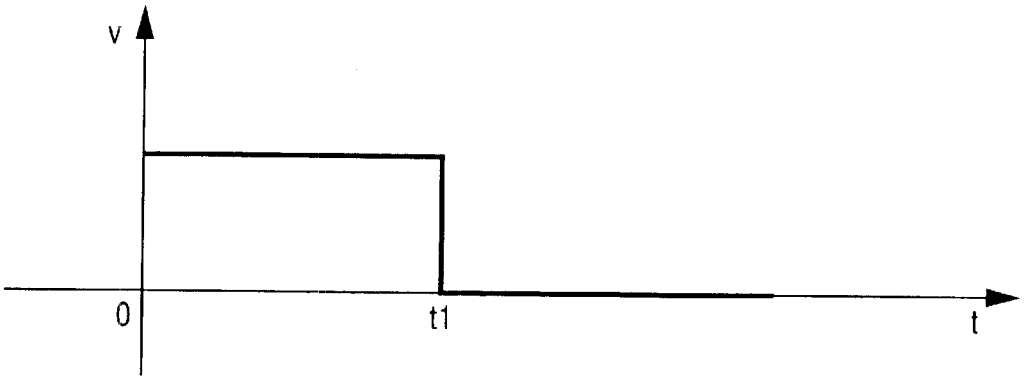
FIG. 10 is a wave form chart showing an electric pulse employed in the present invention for driving the heat generating member.

In order to discharge the liquid by driving the heat generating portion of the electrothermal converting element provided on the aforementioned element substrate, a rectangular pulse as shown in FIG. 10 is applied to the resistance layer 105 through the wiring electrodes 104 to induce rapid heat generation in the electrical resistance layer 105 between the wiring electrodes 104. In the heads of the foregoing embodiments, the heat generating member 2 was driven in the aforementioned manner by a voltage of 24 V, with a pulse duration of a ca. 4 μsec, a current of ca. 100 mA and a driving frequency of 6 kHz or higher to discharge the ink from the discharge port. However the drive signal is not limited to such condition but can be of any condition capable of appropriate bubble generation in the liquid.

<Discharge Liquid>

Among such liquids, the liquid to be used for recording (recording liquid) can be the ink of a composition employed in the conventional bubble jet recording apparatus.

Also there can be employed liquid of low bubble generating property that is conventionally difficult to discharge, or liquid easily denatured or deteriorated by heat, or liquid of a high viscosity.

However such liquid is desirably not to hinder the discharge, bubble generation or the function of the movable member 31.

There may also be employed ink of a high viscosity as the recording liquid.

In the present invention, the recording was executed with the ink of the following composition as the recording liquid. Because the discharge speed of the ink was increased due to the higher discharging force, the landing accuracy of the liquid droplet was improved to obtain a very satisfactory recorded image.

| Composition of dye ink: | |
|---|---|
| Dye C-1 (Food black 2) | 3 wt. % |
| diethylene glycol | 10 wt. % |
| thiodiglycol | 5 wt. % |
| ethanol | 5 wt. % |
| water | 77 wt. % |

<Configuration of Liquid Discharge Head>

Figure 11:
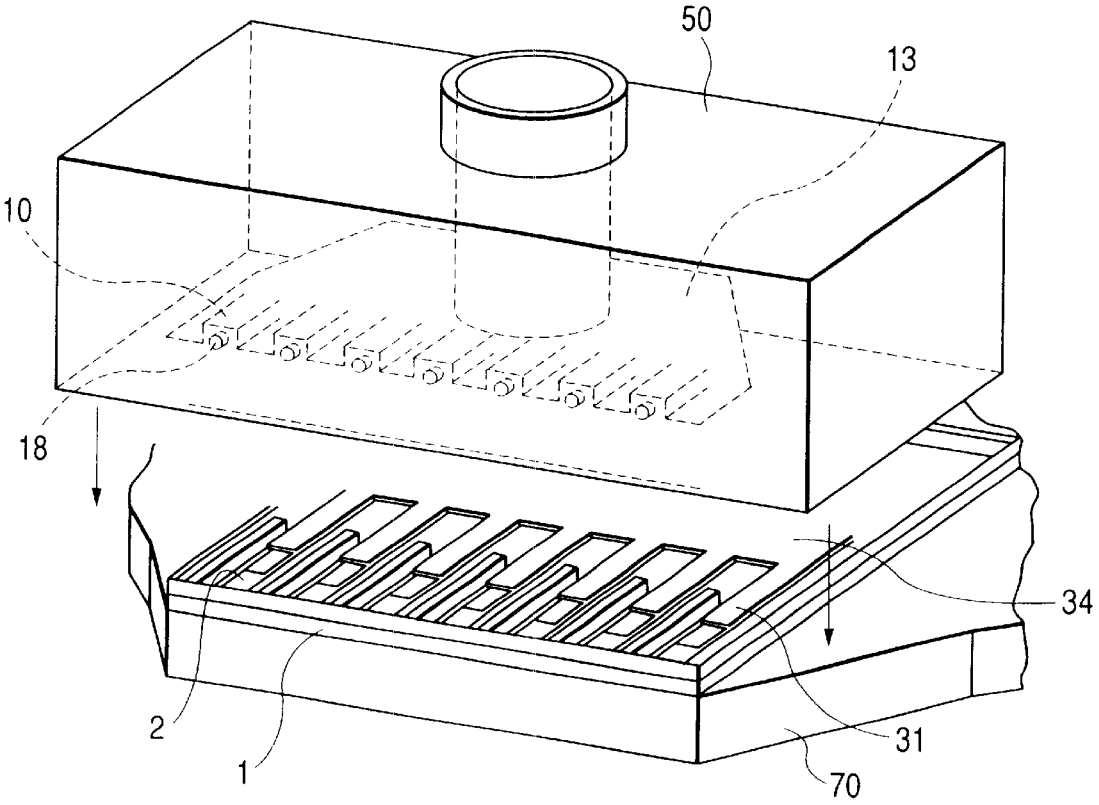
FIG. 11 is an exploded perspective view showing the entire configuration of the liquid discharge head of the present invention.

FIG. 11 is an exploded perspective view showing the entire configuration of the liquid discharge head of the present invention.

In this liquid discharge head, as shown in FIG. 11, a support member 70 composed for example of aluminum supports the element substrate 1 bearing thereon plural heat generating members 2. There is provided thereon a support member 34 supporting the movable members 31 in such a manner that each movable member 31 is opposed to a half of each heat generating member 2 at the side of the common liquid chamber 13. Also provided thereon is the top plate 50 having plural grooves for constituting the liquid flow paths 10 and a recess for constituting the common liquid chamber 13.

<Recording Apparatus>

Figure 13:
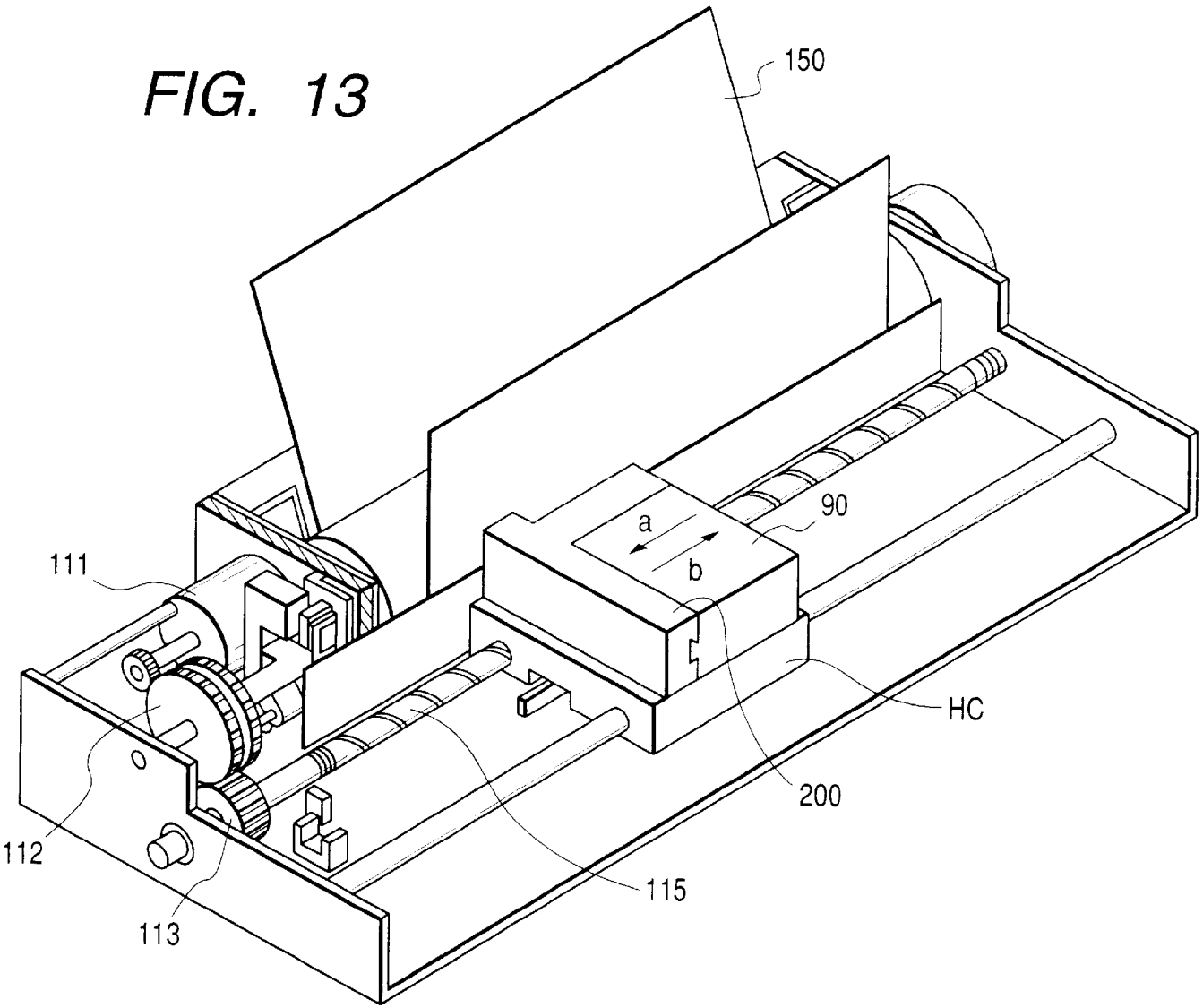
FIG. 13 is a schematic perspective view showing the configuration of a liquid discharge head equipped with a liquid discharge head of the structure shown in FIGS. 1 and 2 or 12A and 12B.

FIG. 13 schematically shows a liquid discharge apparatus including the liquid discharge head of the configuration explained in FIGS. 1 and 2 or in FIGS. 12A and 12B. In the following there will be explained an ink discharge recording apparatus, employing ink as the discharge liquid. A carriage HC of the liquid discharge apparatus supports a head cartridge in which a liquid tank 90 containing ink and a liquid discharge head 200 are detachably mounted, and executes a reciprocating motion across the entire width of a recording medium 150, such as a recording sheet, conveyed by recording medium conveying means.

In response to the supply of a drive signal from unrepresented drive signal supply means to the liquid discharge means on the carriage HC, the liquid discharge head 200 discharges recording liquid onto the recording medium 150.

The liquid discharge apparatus of the present embodiment is provided with a motor 111 for driving the recording medium conveying means and the carriage, gears 112, 113 for transmitting the driving power from the drive source to the carriage, a carriage shaft 115 etc. A satisfactory image recording could be obtained by discharging liquid onto various recording media by the above-described recording apparatus and by the liquid discharge method executed by such recording apparatus.

Figure 14:
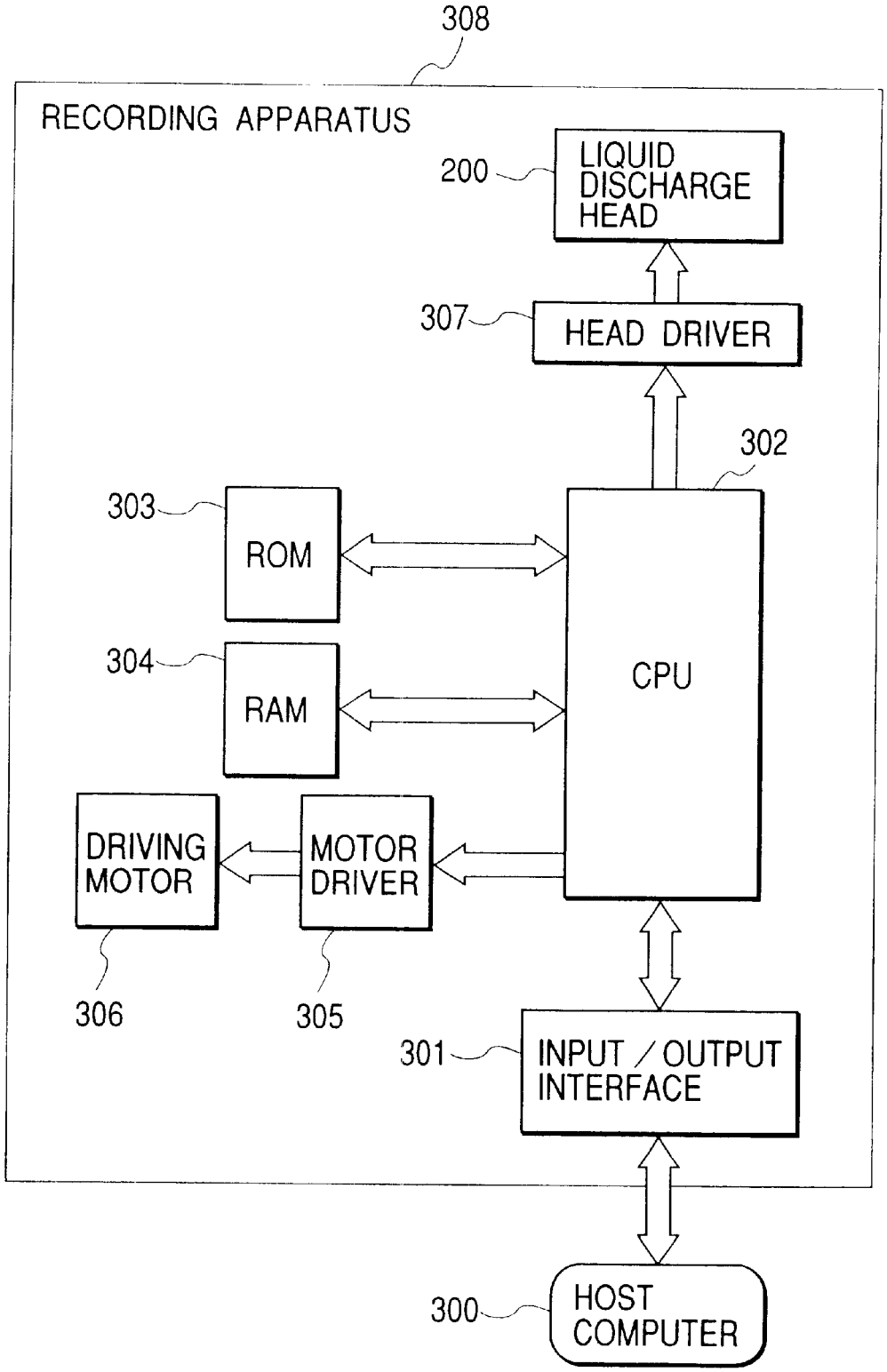
FIG. 14 is a block diagram of the entire apparatus for causing the liquid discharge head capable of executing the liquid discharge method of the present invention, to execute recording by ink discharge.

FIG. 14 is a block diagram of the entire apparatus for causing the liquid discharge head, capable of executing the liquid discharge method of the present invention, to execute ink jet recording.

The recording apparatus receives print information, as a control signal, from a host computer 300. The print information is temporarily stored in an I/O interface 301 in the recording apparatus, and at the same time converted into data processable therein, and entered into a CPU (central processing unit) 302 serving also as head drive signal supply means. The CPU 302 processes the data entered thereto utilizing peripheral units such as a RAM 304 and based on a control program stored in a ROM 303, thereby effecting conversion into print data (image data).

The CPU 302 also prepares drive data for driving a driving motor 306, for moving the recording sheet and the carriage HC supporting the liquid discharge head, in synchronization with the print data, in order to record the print data in an appropriate position on the recording sheet. The image data and the motor driving data are respectively transmitted, through a head driver 307 and a motor driver 305, to the liquid discharge head 200 and the driving motor 306 which are thus driven in respectively controlled timings to form the image.

The recording medium 150 to be employed in such recording apparatus and to receive the deposition of liquid such as ink can be various papers, an OHP sheet, a plastic material employed in a compact disk or a decorating plate, a cloth, a metal material such as of aluminum or copper, a leather material such as cow hide, pig hide or synthetic leather, wood, a wooden material such as plywood, bamboo, ceramics such as a tile, or a three-dimensionally structured material such as sponge.

Also the recording apparatus includes a printer apparatus for recording on various papers or OHP sheet, a plastic recording apparatus for recording on plastic such as a compact disk, a metal recording apparatus for recording on a metal plate, a leather recording apparatus for recording on leather, a wood recording apparatus for recording on a wooden material, a ceramic recording apparatus for recording on ceramics, a recording material for recording on a three-dimensional network structured member such as sponge, and a dyeing apparatus for recording on a cloth.

Also the discharge liquid to be employed in such liquid discharge apparatus can be selected according to the respective recording medium and the recording conditions.

As explained in the foregoing, the valve mechanism of the movable member of the liquid discharge head of the present invention suppresses the liquid movement in the upstream direction, resulting from the backward wave or the pressure wave toward the upstream side, thereby refilling of the liquid into the liquid flow path at the bubble extinction. Also in the consecutive discharging operation, the second or subsequent bubble generation in the liquid is started while the movable member is still displaced to discharge the liquid droplet more efficiently than the preceding liquid droplet and to depositing the plural liquid droplets in a united state onto the recording medium.

It is thus rendered possible to discharge the liquid droplet of plural amounts from a same nozzle, thereby providing a liquid discharge apparatus capable of realizing recording of multi gradation levels and capable of high-speed recording with high image quality.

What is claimed is:

1. A liquid discharge head comprising:

a heat generating member for generating thermal energy for generating a bubble in liquid;

a discharge port constituting a portion for discharging the liquid;

a liquid flow path communicating with said discharge port and including a bubble generating area for generating the bubble in the liquid;

a movable member provided in said liquid flow path and adapted to displace according to the growth of the bubble; and a limiting portion for limiting the displacement of said movable member within a desired range, wherein said liquid discharge head discharges the liquid from said discharge port by energy produced by generation of the bubble, thereby forming a liquid droplet, and causes the liquid droplet to land on a recording medium thereby executing recording, and wherein plural liquid droplets are discharged in a consecutive manner from a same discharge port which are united to form the liquid droplet prior to landing on the recording medium.

2. A liquid discharge head according to claim 1, wherein, in a case of discharging plural liquid droplets in a consecutive manner from said same discharge port, said movable member is in a displaced state at the start of a second or subsequent bubble generation, and a displacement amount of said movable member at the start of the second or subsequent bubble generation is larger than the displacement amount of said movable member at the start of a preceding bubble generation.

3. A liquid discharge head according to claim 1, wherein, in a case of discharging plural liquid droplets in a consecutive manner from said same discharge port, the discharge speed of a second or subsequent liquid droplet is larger than that of a preceding liquid droplet.

4. A liquid discharge head according to claim 1, wherein, in a case of discharging two liquid droplets in a consecutive manner, the second liquid droplet is united with the first liquid droplet before the landing thereof onto the recording medium, thereby forming a liquid droplet of an amount approximately double that of the first liquid droplet.

5. A liquid discharge head according to claim 1, wherein, in a case of discharging three liquid droplets in a consecutive manner, the second and third liquid droplets are united with the first liquid droplet before the landing thereof onto the recording medium, thereby forming a liquid droplet of an amount approximately triple that of the first liquid droplet.

6. A liquid discharge head according to claim 1, wherein said movable member displaces in such a manner as to substantially close an upstream side of said liquid flow path, thereby suppressing movement of the liquid to the upstream side and the growth of the bubble.

7. A liquid discharge head according to claim 1, wherein said heat generating member is an electrothermal converting member and heating of the liquid is performed by supplying a driving pulse to said electrothermal converting member.

8. A liquid discharge head according to claim 1, wherein a state of contact between said movable member and said limiting portion is maintained for a predetermined period from the start of the generation of the bubble.

9. A liquid discharge head according to claim 1, wherein, in a non-displaced state of said movable member, a flow resistance of said liquid flow path at an upstream side, partitioned by said limiting portion, is lower than the flow resistance of said liquid flow path at a downstream side.

10. A liquid discharge head according to claim 1, wherein said heat generating member and said discharge port are in a linearly communicating state.

11. A liquid discharge head according to claim 1, wherein said movable member suppresses only the bubble growing in an upstream direction with respect to said discharge port.

12. A liquid discharge head according to claim 1, wherein said movable member has a free end which is positioned substantially at a center of said bubble generating area.

13. A liquid discharge head according to claim 1, wherein said limiting portion is formed by partially reducing the distance from a wall of said liquid flow path to said movable member.

14. A liquid discharge head according to claim 1, wherein said discharge port is provided opposite said heat generating member.

15. A liquid discharge head according to claim 14, wherein said movable member is provided in plural units for said heat generating member, and said plural movable members are formed symmetrically with respect to a bubble generating center of said heat generating member.

16. A liquid discharge head according to claim 1, wherein, in the case of discharging a plurality of liquid droplets in a consecutive manner, a discharge amount of a second or subsequent liquid droplet is larger than that of a preceding liquid droplet.

17. A liquid discharge head according to claim 1, wherein, in the case of discharging a plurality of liquid droplets in a consecutive manner, a discharge amount of a second or subsequent liquid droplet is smaller than that of a preceding liquid droplet.

18. A liquid discharge apparatus comprising a liquid discharge head according to any of claims 1 to 17 and recording medium conveying means for conveying a recording medium for receiving the liquid discharged from said liquid discharge head.

19. A liquid discharge apparatus according to claim 18, adapted to execute recording by discharging ink from said liquid discharge head and adhering ink onto the recording medium.

20. A liquid discharge method for a liquid discharge head that comprises:

a heat generating member for generating thermal energy for generating a bubble in liquid, a discharge port constituting a portion for discharging the liquid, a liquid flow path communicating with the discharge port and including a bubble generating area for generating the bubble in the liquid, a movable member provided in the liquid flow path and adapted to displace according to the growth of the bubble, and a limiting portion for limiting the displacement of the movable member within a desired range, wherein the liquid discharge head discharges the liquid from the discharge port by energy produced by generation of the bubble, thereby forming a liquid droplet, and causes the liquid droplet to land on a recording medium, thereby executing recording, said method comprising the step of:

discharging plural liquid droplets in a consecutive manner from a same discharge port which are united to form the liquid droplet prior to landing on the recording medium.

21. A liquid discharge method according to claim 20, wherein, in said step of discharging plural liquid droplets in a consecutive manner from the same discharge port, the movable member is in a displaced state at the start of a second or subsequent bubble generation, and a displacement amount of the movable member at the start of the second or subsequent bubble generation is larger than the displacement amount of said movable member at the start of a preceding bubble generation.

22. A liquid discharge method according to claim 20, wherein a gradation recording is executed by repeating said discharge step, wherein at least some of the united liquid droplets have different amounts of liquid.

23. A liquid discharge method according to claim 20, wherein, when discharging a plurality of liquid droplets in a consecutive manner from said same discharge port, bubble generation is started for discharging a second or subsequent liquid droplet during a downward displacement of said movable member.

24. A liquid discharge method according to claim 20, wherein, when discharging a plurality of liquid droplets in a consecutive manner from said same discharge port, bubble generation is started for discharging a second or subsequent liquid droplet during an upward displacement of said movable member.

25. A liquid discharge method according to claim 20, wherein, when discharging a plurality of liquid droplets in a consecutive manner from said same discharge port, said movable member is in an initial state at a start of a second or subsequent bubble generation, and a following bubble generation is started when said movable member returns to the initial state from a displaced state to which said movable member had been displaced following the start of the second or subsequent bubble generation.

26. A liquid discharge method according to claim 20, wherein volumes of the consecutive liquid droplets are substantially the same.

27. A liquid discharge method according to claim 22, wherein, when discharging a plurality of liquid droplets in a consecutive manner from said same discharge port, the gradation recording is executed by changing an amount of a second or subsequent liquid droplet.

* * * * *

UNITED STATES PATENT AND TRADEMARK OFFICE

CERTIFICATE OF CORRECTION

PATENT NO. : 6,409,296 B1
DATED : June 25, 2002
INVENTOR(S) : Yoshinori Misumi et al.

It is certified that error appears in the above-identified patent and that said Letters Patent is hereby corrected as shown below:

Column 1,
Line 22, “in” should read -- in a --;
Line 43, “Such” should read -- Such a --;
Line 46, “such” should read -- such a --; and
Line 47, “recording” should read -- record --.

Column 2,
Line 53, “different completely” should read -- that are completely different --.

Column 3,
Line 30, “member” should read -- members --.

Column 4,
Line 33, “heading” should read -- heating --.

Column 5,
Lines 2 and 6, “is a” should read -- are --; and “view” should read -- views --;
Line 43, “12B; and” should read -- 12B; --;
Line 47, “discharge.” should read -- discharge; and --;
Line 48, “illustrates a” should read -- illustrate --; and “example” should read -- examples --.

Column 8,
Line 9, “a state in” should be deleted.

Column 9,
Line 2, “ps,” should read -- $\mu$s, --; and
Line 2, “n” should read -- in --.

Column 10,
Line 15, “same” should read -- the same --; and
Line 59, “greater.” should read -- greater --.

Column 11,
Line 12, “error in” should read -- fewer errors in a --; and “of droplet few.” should read -- of each droplet. --.

Column 15,
Line 29, “proceeds” should read -- proceed --.

UNITED STATES PATENT AND TRADEMARK OFFICE

CERTIFICATE OF CORRECTION

PATENT NO. : 6,409,296 B1 
DATED : June 25, 2002
INVENTOR(S) : Yoshinori Misumi et al.

It is certified that error appears in the above-identified patent and that said Letters Patent is hereby corrected as shown below:

Column 18,
Line 39, "depositing" should read -- deposit --.

Signed and Sealed this

Twenty-second Day of April, 2003

JAMES E. ROGAN
*Director of the United States Patent and Trademark Office*